US007963796B2

(12) United States Patent
Sypolt et al.

(10) Patent No.: US 7,963,796 B2
(45) Date of Patent: Jun. 21, 2011

(54) BRIDGE CONNECTORS AND CIRCUIT BOARD ASSEMBLIES INCLUDING THE SAME

(75) Inventors: Matthew Sypolt, Harrisburg, PA (US); James Lee Fedder, Etters, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/608,728

(22) Filed: Oct. 29, 2009

(65) Prior Publication Data

US 2011/0104911 A1 May 5, 2011

(51) Int. Cl.
*H01R 31/08* (2006.01)

(52) U.S. Cl. ..... 439/511; 439/65

(58) Field of Classification Search ..... 439/511, 439/65

See application file for complete search history.

(56) References Cited

U.S. PATENT DOCUMENTS

| | | | | |
|---|---|---|---|---|
| 4,938,701 | A | 7/1990 | Heberling | |
| 5,742,484 | A | 4/1998 | Gillette et al. | |
| 6,031,730 | A | 2/2000 | Kroske | |
| 6,188,583 | B1 | 2/2001 | Fendt | |
| 6,315,581 | B1 | 11/2001 | Yu | |
| 6,594,152 | B2 | 7/2003 | Dent | |
| 6,612,851 | B1 | 9/2003 | Goodwin | |
| 6,623,280 | B2 | 9/2003 | Oldenburg et al. | |
| 6,781,822 | B1 | 8/2004 | Mercer et al. | |
| 7,203,074 | B1 | 4/2007 | Yaung et al. | |
| 7,226,309 | B1 * | 6/2007 | Gretz | 439/460 |
| 7,232,324 | B2 * | 6/2007 | Oesterhaus | 439/511 |
| 7,618,283 | B1 * | 11/2009 | Costello | 439/511 |
| 2004/0018757 | A1 | 1/2004 | Lang et al. | |
| 2007/0275587 | A1 | 11/2007 | Chang et al. | |

* cited by examiner

*Primary Examiner* — Briggitte R Hammond

(57) ABSTRACT

A bridge connector configured to electrically and mechanically couple adjacent circuit boards. The connector includes a connector housing that has a mating side configured to interface with board surfaces of adjacent circuit boards when mounted thereon. The housing includes a contact-receiving slot that at least partially defines a restricted space. The connector also includes a bridge contact that is held within the slot and the restricted space. The bridge contact has a pair of contact ends that are spaced apart from each other and project from the mating side. The contact ends are inserted into corresponding through-holes of the adjacent circuit boards when the housing is mounted thereon. The bridge contact is sized and shaped relative to the restricted space to float within the slot such that the bridge contact at least one of shifts and pivots therein.

20 Claims, 5 Drawing Sheets

BRIDGE CONNECTORS AND CIRCUIT BOARD ASSEMBLIES INCLUDING THE SAME

BACKGROUND OF THE INVENTION

The subject matter herein relates generally to electrical connectors, and more particularly, to bridge connectors that mechanically and electrically couple two or more circuit boards together.

Some electrical devices or systems use circuit board assemblies in which two or more circuit boards are fastened together. The circuit boards may be electrically coupled together in order to allow the circuit boards to transmit information between each other. For example, some known touchscreen systems utilize a display panel having multiple layers stacked upon each other. One of the layers may be a circuit board assembly having several circuit boards fastened together in a frame that forms the perimeter of a touchscreen area. The circuit boards are typically coplanar and include LEDs and phototransistor receivers. The LEDs and receivers form an optical grid along the touchscreen area that is used to determine the location of a touch. When a user touches the touchscreen area, the optical grid registers the touch information and relays the information through the circuit board assembly to a controller of the touchscreen system.

In one known method for coupling circuit boards together, a first circuit board is positioned adjacent to a second circuit board such that edges of the circuit boards are proximate to each other. Each circuit board includes a plurality of contact areas, such as bonding pads, that are formed along a corresponding edge. The contact areas of the first circuit board are aligned with the corresponding contact areas of the second circuit board. A conductive band formed from a conductive material is used to electrically couple the associated contact areas. However, although the circuit boards are electrically coupled to each other through the conductive bands, the conductive bands may not provide sufficient support to facilitate maintaining the positions of the circuit boards.

Other known methods include soldering contacts to the surfaces of adjacent circuit boards and/or using resins or adhesives to couple the circuit boards together. However, these methods may have a limited ability to mechanically couple the circuit boards together such that the circuit boards maintain their spatial relationship.

Furthermore, conductive bands that electrically connect circuit boards may disconnect or become damaged, for example, when the circuit board assembly is moved during a manufacturing process. More specifically, the circuit boards may become misaligned with respect to each other thereby bending the conductive bands.

Thus, there is a need for bridge connectors that both electrically and mechanically couple two or more circuit boards together. There is also a need for a connector that may facilitate maintaining the mechanical and electrical connection between the circuit boards when the circuit boards are not properly oriented with respect to each other.

BRIEF DESCRIPTION OF THE INVENTION

In one embodiment, a bridge connector configured to electrically and mechanically couple adjacent circuit boards is provided. Each circuit board includes a board surface having through-holes. The connector includes a connector housing that has a mating side configured to interface with the board surfaces of the adjacent circuit boards when mounted thereon. The housing includes a contact-receiving slot that at least partially defines a restricted space. The connector also includes a bridge contact that is held within the slot and the restricted space. The bridge contact has a pair of contact ends that are spaced apart from each other and project from the mating side. The contact ends are inserted into corresponding through-holes of the adjacent circuit boards when the housing is mounted thereon. The bridge contact is sized and shaped relative to the restricted space to float within the slot such that the bridge contact at least one of shifts and pivots therein. The contact ends move relative to the mating side when the bridge contact floats within the slot.

In another embodiment, a bridge connector configured to electrically and mechanically couple adjacent circuit boards is provided. Each circuit board includes a board surface having through-holes. The connector includes a connector housing that has a mating side configured to interface with the board surfaces of the adjacent circuit boards. The housing includes a contact-receiving slot that has a slot opening. The connector also includes a bridge contact that is configured to be inserted into the slot through the slot opening. The slot holds the bridge contact within the housing. The bridge contact has contact ends that project from the mating side. The contact ends are configured to be inserted into corresponding through-holes to electrically and mechanically couple the adjacent circuit boards. The connector also includes a locking feature located proximate to the slot opening. The locking feature engages the bridge contact to prevent the bridge contact from moving out of the slot when the bridge contact is held therein.

In yet another embodiment, a circuit board assembly is provided that includes a plurality of circuit boards. Each circuit board includes a board surface having through-holes. The circuit board assembly also includes at least one bridge connector that is configured to electrically and mechanically couple adjacent circuit boards to each other. The connector includes a connector housing that has a mating side configured to interface with the board surfaces of the adjacent circuit boards when mounted thereon. The housing includes a contact-receiving slot that at least partially defines a restricted space. The connector also includes a bridge contact that is held within the slot and the restricted space. The bridge contact has a pair of contact ends that are spaced apart from each other and project from the mating side. The contact ends are inserted into corresponding through-holes of the adjacent circuit boards when the housing is mounted thereon. The bridge contact is sized and shaped relative to the restricted space to float within the slot such that the bridge contact at least one of shifts and pivots therein. The contact ends move relative to the mating side when the bridge contact floats within the slot.

DETAILED DESCRIPTION OF THE INVENTION

Figure 1:
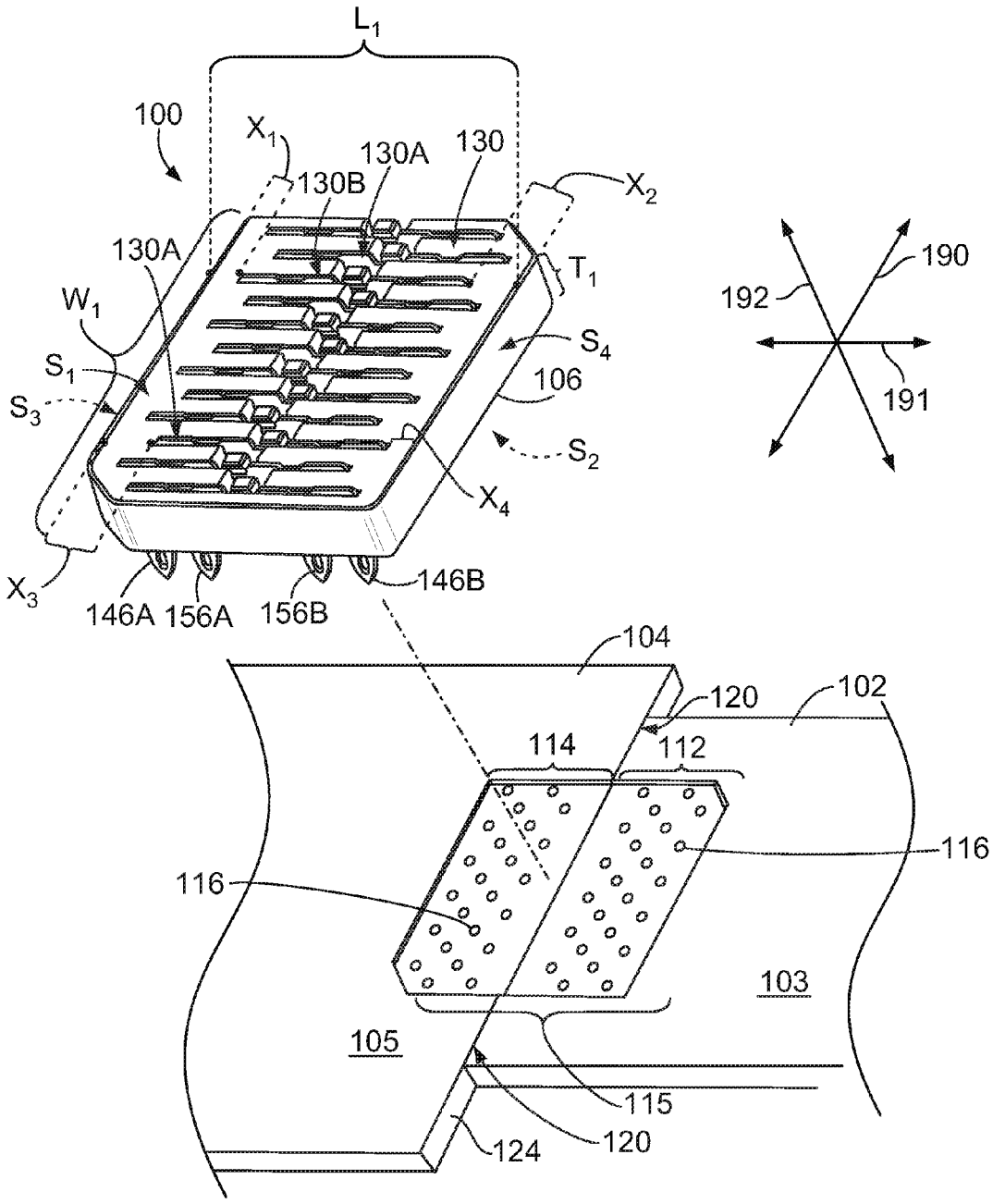
FIG. 1 is a perspective view of a bridge connector formed in accordance with one embodiment.

FIG. 1 is a perspective view of a bridge connector 100 formed in accordance with one embodiment and first and second circuit boards 102 and 104. The connector 100 is configured to be mounted onto the circuit boards 102 and 104 to mechanically and electrically couple the circuit boards 102 and 104 together. As shown, the circuit boards 102 and 104 may have predetermined positions or orientations with respect to each other before the connector 100 is mounted thereon. In some embodiments, the connector 100 may facilitate maintaining the predetermined positions of the circuit boards 102 and 104 with respect to each other. For example, the circuit boards 102 and 104 may be adjacent and coplanar with respect to each other and the connector 100 may facilitate maintaining the spatial relationship. Furthermore, in some embodiments, the connector 100 may include features that facilitate mounting the connector 100 onto the circuit boards 102 and 104 when the circuit boards 102 and 104 are not in predetermined or desired positions with respect to each other. For example, the circuit boards 102 and 104 may not be properly oriented or aligned with one another. Alternatively or in addition to, the connector 100 may tolerate relative movement between the circuit boards 102 and 104 after the connector 100 has been mounted thereon.

In the illustrated embodiment, the exclusive function of the connector 100 is to mechanically and electrically couple the circuit boards 102 and 104 together. For example, in the illustrated embodiment, the connector 100 does not include additional circuitry or modules that at least one of monitor and modify electrical signals that are transmitted through the connector 100. However, in other embodiments, the connector 100 may include modules that at least one of monitor and modify the transmitted signals. Furthermore, in alternative embodiments, the connector 100 may be included as one part or component of an electrical device or the features of the connector 100 may be incorporated into a larger system or structure.

By way of example, the connector 100 may be used in constructing a circuit board assembly for use in an infrared (IR) touch system, such as modular flat panels. Although FIG. 1 illustrates two circuit boards 102 and 104, alternative embodiments of the connector 100 may be configured to engage more than two circuit boards (e.g., three, four, or more circuit boards). Also, a plurality of connectors 100 may be used to interconnect several circuit boards into a circuit board assembly. The connectors 100 may facilitate holding the circuit boards in a predetermined arrangement. For example, the circuit boards may be linearly arranged end-to-end or the circuit boards may be arranged in a rectangular frame.

Figure 2:
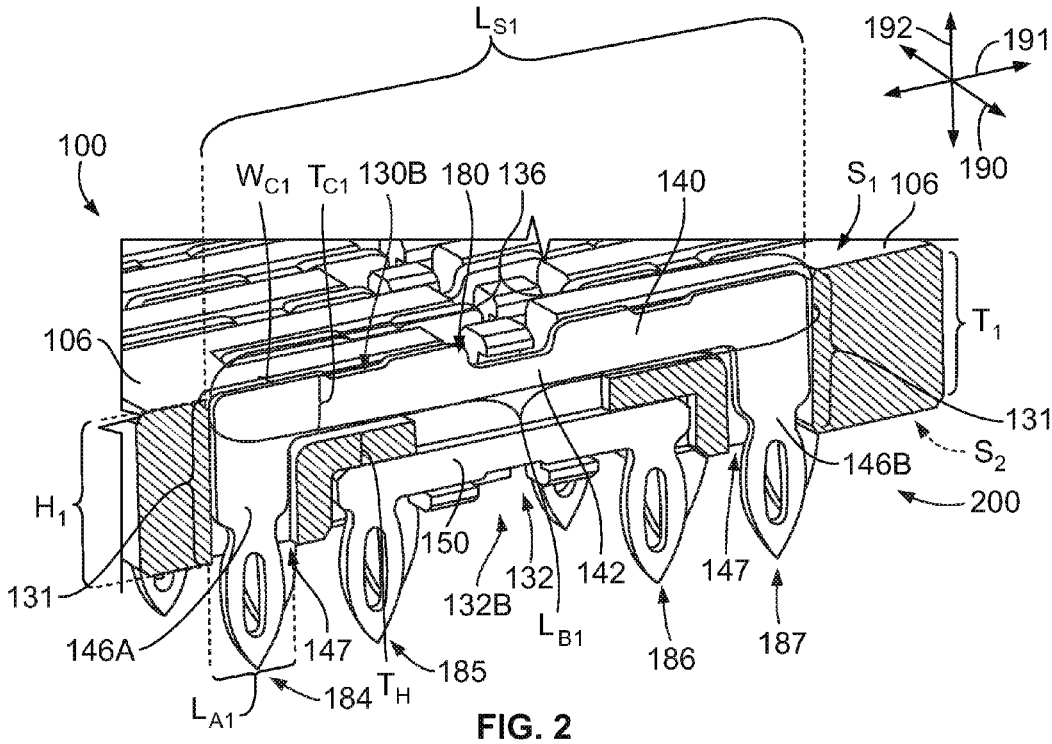
FIG. 2 is a perspective cross-sectional view of the connector shown in FIG. 1 illustrating details of an upper bridge contact.
Figure 3:
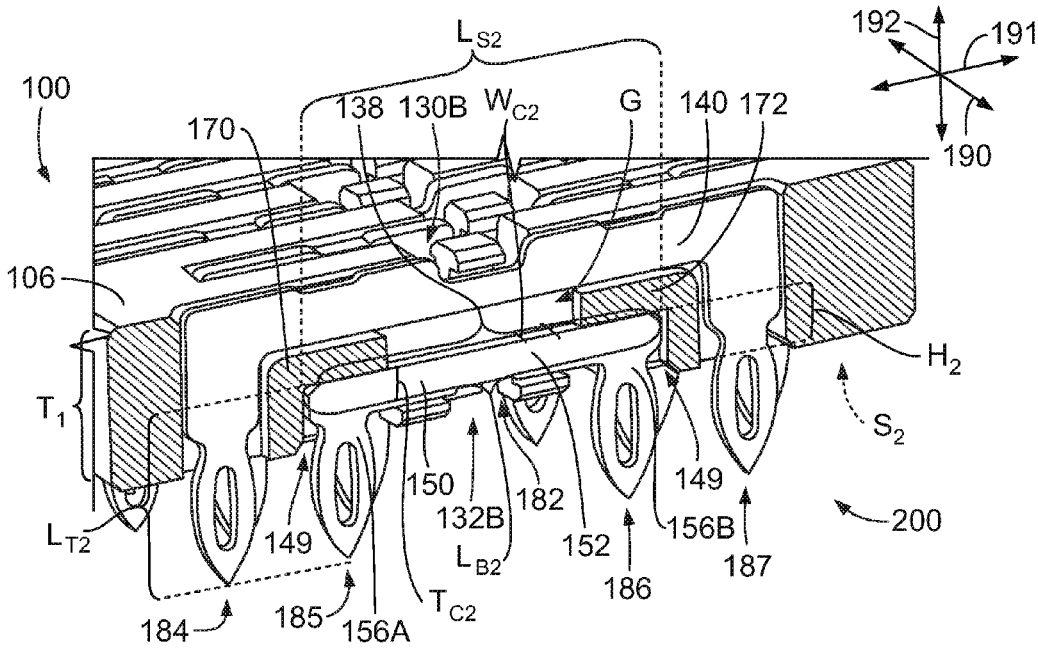
FIG. 3 is a perspective cross-sectional view of the connector shown in FIG. 1 illustrating details of a lower bridge contact.

As shown, the connector 100 includes a connector housing 106 that holds a plurality of bridge contacts 140 and 150 (shown in FIGS. 2 and 3). The housing 106 may be formed from a dielectric material during, for example, an injection molding process. In one embodiment, the housing 106 has a rigid body or structure. As shown in FIG. 1, the housing 106 may be oriented with respect to axes 190-192 and have dimensions that extend along the axes 190-192. The axes 190-192 are oriented perpendicular to one another. For example, the housing 106 may have a substantially rectangular body and include a first dimension or length $L_1$ that extends in a direction of a first lateral axis 191, a second dimension or width $W_1$ that extends in a direction of a second lateral axis 190, and a third dimension or thickness $T_1$ that extends in a direction of a vertical axis 192. In alternative embodiments, the housing 106 may be shaped in other manners.

The housing 106 may be shaped to have a plurality of sides including a non-mating or loading side $S_1$ and a mating side $S_2$. The loading and mating sides $S_1$ and $S_2$ may face in opposite directions. The loading side $S_1$ may face away from the circuit boards 102 and 104 when the housing 106 is mounted thereon, and the mating side $S_2$ may interface with board surfaces 103 and 105 of the circuit boards 102 and 104, respectively, when the housing 106 is mounted thereon. The bridge contacts 140 and 150 may extend substantially across at least one dimension of the housing 106 to connect the adjacent circuit boards 102 and 104. For example, the bridge contacts 140 and 150 may extend lengthwise (i.e., in the direction of the lateral axis 191) through the housing 106.

The bridge contacts 140 may have outer tail portions 146, and the bridge contacts 150 may have inner tail portions 156. The tail portions 146 and 156 project from the mating side $S_2$ in a direction along the vertical axis 192 and perpendicular to the board surfaces 103 and 105. The tail portions 146 and 156 may form any predetermined or desired arrangement on the mating side $S_2$. For example, the tail portions 146 and 156 may form an arrangement that facilitates mechanically holding the circuit boards 102 and 104 in the predetermined positions.

As shown in FIG. 1, the board surfaces 103 and 105 may form planes that are substantially coplanar with respect to each other and parallel with respect to a board plane formed by the lateral axes 190 and 191. The board surfaces 103 and 105 may include engagement areas 112 and 114, respectively, having associated through-holes 116 extending therethrough. When the circuit boards 102 and 104 are aligned, the engagement areas 112 and 114 collectively form a mounting area 115 of the circuit boards 102 and 104 where the connector 100 is mounted thereon. The through-holes 116 form a pattern or an array that is similar to the arrangement of tail portions 146 and 156 that project from the mating side $S_2$. When the connector 100 is mounted thereon, each through-hole 116 may form a press or interference fit with a corresponding tail portion 146 or 156 to electrically couple the circuit boards 102 and 104 and also to facilitate mechanically coupling the circuit boards 102 and 104.

To mount the connector 100 onto the circuit boards 102 and 104, the connector 100 is aligned with the mounting area 115 so that the tail portions 146 and 156 may be inserted into the corresponding through-holes 116. When the tail portions 146 and 156 are inserted into the corresponding through-holes 116, the combined interference fits may provide a tactile indication (i.e., snap-fit) to an operator that the connector 100 has been mounted to the circuit boards 102 and 104. The combined interference fits may also collectively form a rigid connection to the circuit boards 102 and 104 that mechanically holds the circuit boards 102 and 104 along the mating side $S_2$. In some embodiments, the combined interference fits between the tail portions 146 and 156 and the corresponding through-holes 116 provides the only force that holds the mating side $S_2$ against the board surfaces 103 and 105. For example, the connector 100 may mechanically and electrically engage the circuit boards 102 and 104 without additional fasteners (e.g., screws, latches, plugs, and the like).

As used herein, the term "to mount" includes the connector being mounted to a top surface of the circuit boards such that the mating side faces in a direction along the gravitational force, and also includes the connector being mounted to a bottom surface of the circuit boards such that the non-mating side faces in a direction along the gravitational force. The term "to mount" also includes the connector 100 being oriented in a more vertical manner. For example, the length $L_1$ of the housing 106 shown in FIG. 1 may extend in a direction along the vertical axis 192.

Also shown in FIG. 1, the circuit boards 102 and 104 may include edges 122 and 124, respectively. When the circuit boards 102 and 104 are coupled to the connector 100, the edges 122 and 124 may abut each other along an edge interface 120. The edges 122 and 124 may directly abut each other or may have a gap therebetween. As shown in FIG. 1, the edge interface 120 may be substantially linear. However, alternative embodiments may include the edges 122 and 124 having complementary protrusions or teeth such that the circuit boards 102 and 104 may mate with each other before the connector 100 is mounted thereon.

Furthermore, the housing 106 may include a plurality of upper contact-receiving slots 130 and lower contact-receiving slots 132 (shown in FIG. 2) that extend lengthwise along the housing 106. In alternative embodiments, the slots 130 and the slots 132 may extend widthwise or diagonally across the housing 106.

As shown in FIG. 1, the slots 130 may be staggered along the width $W_1$ (FIG. 1) such that the slots 130 are disposed in an alternating sequence of slots 130A, 130B at respective different distances from sides $S_3$ and $S_4$ of the housing 106. More specifically, the slot 130B begins at a distance $X_1$ from a side $S_3$. The slot 130B then extends along the length $L_1$ (FIG. 1) toward the side $S_4$ and ends at a distance $X_2$ from the side $S_4$. Although in some embodiments $X_1$ and $X_2$ may be substantially equal, $X_1$ is less than $X_2$ in the illustrated embodiment. Furthermore, the slot 130A begins at a distance $X_3$ from a side $S_3$. The slot 130A then extends along the length $L_1$ toward the side $S_4$ and ends at a distance $X_4$ from the side $S_4$. Although in some embodiments $X_3$ and $X_4$ may be substantially equal, $X_4$ is less than $X_3$ in the illustrated embodiment.

Although not shown, the slots 132 may be similarly staggered with respect to each other. Consequently, the corresponding bridge contacts 140 and 150 (FIGS. 2 and 3) may also be staggered. In such embodiments, the staggered arrangement of tail portions 146 and 156 may facilitate holding the circuit boards 102 and 104 in the predetermined positions with respect to each other.

FIGS. 2 and 3 are perspective cross-sectional views of the connector 100 taken along one pair of upper and lower slots 130B and 132B. Although the following description is with reference to upper and lower slots 130B and 132B, the description may be similarly applied to slot 130A and the associated lower slot 132, which are staggered with respect to the slots 130B and 132B as described above. As shown, the slots 130B and 132B are configured to receive the bridge contacts 140 and 150, respectively. The slot 130B may be vertically stacked over the slot 132B such that the bridge contacts 140 and 150 form a contact row 200 within the housing 106. In the illustrated embodiment, the slot 130B and slot 132B extend along a common plane that is parallel to a vertical plane formed by the axes 192 and 191 and are perpendicular to the board surfaces 103 and 105 (FIG. 1) when the housing 106 is mounted to the circuit boards 102 and 104 (FIG. 1). Likewise, the bridge contacts 140 and 150 may be coplanar when held by the slots 130B and 132B, respectively.

With reference to FIG. 2, the slot 130B has a slot opening 180 that opens onto the loading side $S_1$ of the housing 106. The slot 130B includes a lateral section 136 that extends along the loading side $S_1$ and includes the slot opening 180. The slot 130B also includes a pair of spaced apart vertical sections 131 that extend through the thickness $T_1$ of the housing 106. In the illustrated embodiment, the vertical sections 131 extend from the slot opening 180 to corresponding apertures 147 that open onto the mating side $S_2$. The lateral section 136 extends between and joins the vertical sections 131. In the illustrated embodiment, the lateral section 136 is oriented in a perpendicular manner to the vertical sections 131.

The slot 130B has a width $W_{S1}$ (shown in FIG. 4) that extends in a direction along the lateral axis 190. The slot 130B also includes a slot length $L_{S1}$ that is measured along the lateral section 136 and extends in a direction along the lateral axis 191. In the illustrated embodiment, a size and shape of the slot opening 180 is defined by the width $W_{S1}$ and the slot length $L_{S1}$. Furthermore, the slot 130B also includes a height $H_1$ measured between the loading and mating sides $S_1$ and $S_2$. The height $H_1$ extends in a direction along the vertical axis 192 and may be substantially equal to the thickness $T_1$. Also shown, the apertures 147 have an aperture length $L_{A1}$ and the apertures 147 are sized and shaped to permit insertion of the contact ends 184 and 187 of the bridge contact 140 therethrough.

Also shown in FIG. 2, the bridge contact 140 includes a body portion 142 and a pair of spaced apart tail portions 146A and 146B. The body portion 142 has a body length $L_{B1}$ and extends between the tail portions 146A and 146B in a direction along the lateral axis 191. In the illustrated embodiment, the body portion 142 may be exposed to the surrounding environment along the loading side $S_1$. Furthermore, the body portion 142 may extend parallel a surface of the loading side $S_1$, and may extend parallel to the board surfaces 103 and 105 (FIG. 1) when the connector 100 is mounted thereon. The tail portions 146A and 146B may be oriented parallel to one another and extend in a direction along the vertical axis 192 to respective contact ends 184 and 187. Each of the tail portions 146A and 146B may extend a tail length $L_{T1}$. The contact ends 184 and 187 may be shaped to facilitate locating and being inserted into corresponding through-holes 116 (shown in FIG. 1). In the illustrated embodiment, the bridge contact 140 has a U-shaped or C-shaped contour where the tail portions 146A and 146B project in a substantially common direction. Also, the bridge contact 140 has a thickness $T_{C1}$ and a width $W_{C1}$.

With reference to FIG. 3, the slot 132B has a slot opening 182 that opens onto the mating side $S_2$ of the housing 106. The slot 132B includes a lateral section 138 that extends along the mating side $S_2$ and includes the slot opening 182. The slot 132B also includes a pair of spaced apart apertures 149 that open onto the mating side $S_2$. The lateral section 138 extends between the apertures 149. Also shown, the slot 132B has a width $W_{S2}$ (shown in FIG. 4) that extends in a direction along the lateral axis 190. The width $W_{S2}$ may be substantially equal to the width $W_{S1}$ (FIG. 2). The slot 132B also includes a slot length $L_{S2}$ measured along the lateral section 138 that extends in a direction along the lateral axis 191. In the illustrated embodiment, a size and shape of the slot opening 182 is defined by the width $W_{S2}$ and the slot length $L_{S2}$.

Also shown in FIG. 3, the bridge contact 150 includes a body portion 152 and a pair of spaced apart tail portions 156A and 156B that include contact ends 185 and 186, respectively. The body portion 152 has a body length $L_{B2}$ and extends between the tail portions 156A and 156B in a direction along the lateral axis 191. In the illustrated embodiment, the body portion 152 may be exposed to the surrounding environment along the mating side $S_2$. Furthermore, the body portion 152 may extend parallel a surface of the mating side $S_2$, and may extend parallel to the board surfaces 103 and 105 (FIG. 1) when the connector 100 is mounted thereon. The tail portions 156A and 156B and corresponding contact ends 185 and 186 may be oriented parallel to one another and extend in a direction along the vertical axis 192. Each of the tail portions 156A and 156B may extend a tail length $L_{T2}$. The contact ends 185 and 186 may be shaped to facilitate locating the through-holes 116 (FIG. 1) and inserting the contact ends 185 and 186 into the through-holes 116. Also, the bridge contact 150 may have a thickness $T_{C2}$ and a width $W_{C2}$.

As shown in FIGS. 2 and 3, the bridge contacts 140 and 150 may be held within the housing 106 in a stacked relationship. For example, the bridge contact 140 may surround the bridge contact 150 such that the bridge contact 150 is nested within the bridge contact 140. The bridge contacts 140 and 150 may be separated from each other by spacers 170 and 172 (FIG. 3). The spacers 170 and 172 may be formed from the housing material and be located between the bridge contacts 140 and 150. As shown in FIG. 3, a gap G may extend between the spacers 170 and 172.

In alternative embodiments, the bridge contacts 140 and 150 may have other shapes. For example, the body portion 152 (FIG. 3) may jog or deviate with respect to the body portion 142 (FIG. 2) in order to make the electrical paths of the bridge contacts 140 and 150 substantially equal. Furthermore, in alternative embodiments, the bridge contacts 140 and 150 may not be exposed to surrounding environment but may be enclosed within the housing 106.

In some embodiments, the connector 100 may be a low-profile connector. As used herein, the term "low-profile" generally means that the thickness $T_1$ of the connector 100 is configured to take up a minimal amount of space. As one example, the thickness $T_1$ of the connector 100 may be less than 1.5 times a sum of the thicknesses $T_{C1}$ (FIG. 2) and $T_{C2}$ (FIG. 3) of the bridge contacts 140 and 150, respectively, plus a thickness $T_H$ (FIG. 2) of the spacers 170 and 172 (FIG. 3). In a more particular embodiment, the thickness $T_1$ of the connector 100 may be substantially equal to a sum of the thicknesses $T_{C1}$ and $T_{C2}$ of the bridge contacts 140 and 150, respectively, plus the thickness $T_H$ of the spacers 170 and 172. However, alternative embodiments of the connector 100 are not required to be low-profile.

Furthermore, in some embodiments, the connector 100 consists essentially of the housing 106 and a plurality of the bridge contacts 140 and 150. For example, the connector 100 may be formed from only the housing 106 and the bridge contacts 140 and/or 150.

Also shown in FIGS. 2 and 3, the contact ends 184-187 may include eye-of-needle shaped pins for forming an interference fit with the corresponding through-holes 116 (FIG. 1). When the eye-of-needle contact ends 184-187 are inserted into the corresponding through-holes, the contact ends 184-187 may be compressed by the interior wall of the through-holes 116. However, in alternative embodiments, the contact ends 184-187 may have a variety of shapes for being inserted into and engaging the corresponding through-holes. In one alternative embodiment, the contact ends 184-187 do not include eye-of-needle shaped pins, but have solder balls for soldering the tail portions 146 and 156 to corresponding contact pads on the circuit boards 102 and 104.

As will be described in greater detail below, the slot 130B and the bridge contact 140 may be respectively sized and shaped so that the bridge contact 140 is floatable within the slot 130B. With specific reference to FIG. 2, the dimensions of the slot 130B (i.e., the width $W_{S1}$, body length $L_{S1}$, and height $H_1$) may at least partially define a restricted space 222 (shown FIG. 5). The restricted space 222 may be shaped similarly to, but larger than, a spatial volume of the bridge contact 140. More specifically, the bridge contact 140 may be sized and shaped with respect to the restricted space 222 so that the bridge contact 140 is permitted to pivot and/or shift within the restricted space 222.

For example, the width $W_{S1}$ may be greater than the width $W_{C1}$ of the bridge contact 140 to allow the bridge contact 140 to move in a lateral direction along the lateral axis 190. The slot length $L_{S1}$ may be greater than the body length $L_{B1}$ of the body portion 142 to permit the bridge contact 140 to shift in a lateral manner (i.e., in a substantially linear direction along the lateral axis 191). Likewise, the height $H_1$ may be configured to permit the bridge contact 140 to move along the vertical axis 192 so that the contact ends 184-187 are moveable in a vertical direction to and from the corresponding board surfaces 103 and 105 (FIG. 1).

Similarly, the slot 132B and the bridge contact 150 may be respectively sized and shaped so that the bridge contact 150 is floatable within the slot 132B. With specific reference to FIG. 3, the dimensions of the slot 132B (i.e., the width $W_{S2}$, slot length $L_{S2}$, and a height $H_2$) may at least partially define a restricted space 224 (shown in FIG. 5). The restricted space 224 may be shaped similarly to, but larger than, a spatial volume of the bridge contact 150. More specifically, the bridge contact 150 may be sized and shaped with respect to the restricted space 224 so that the bridge contact 150 is permitted to pivot and/or shift within the restricted space 224.

Figure 4:
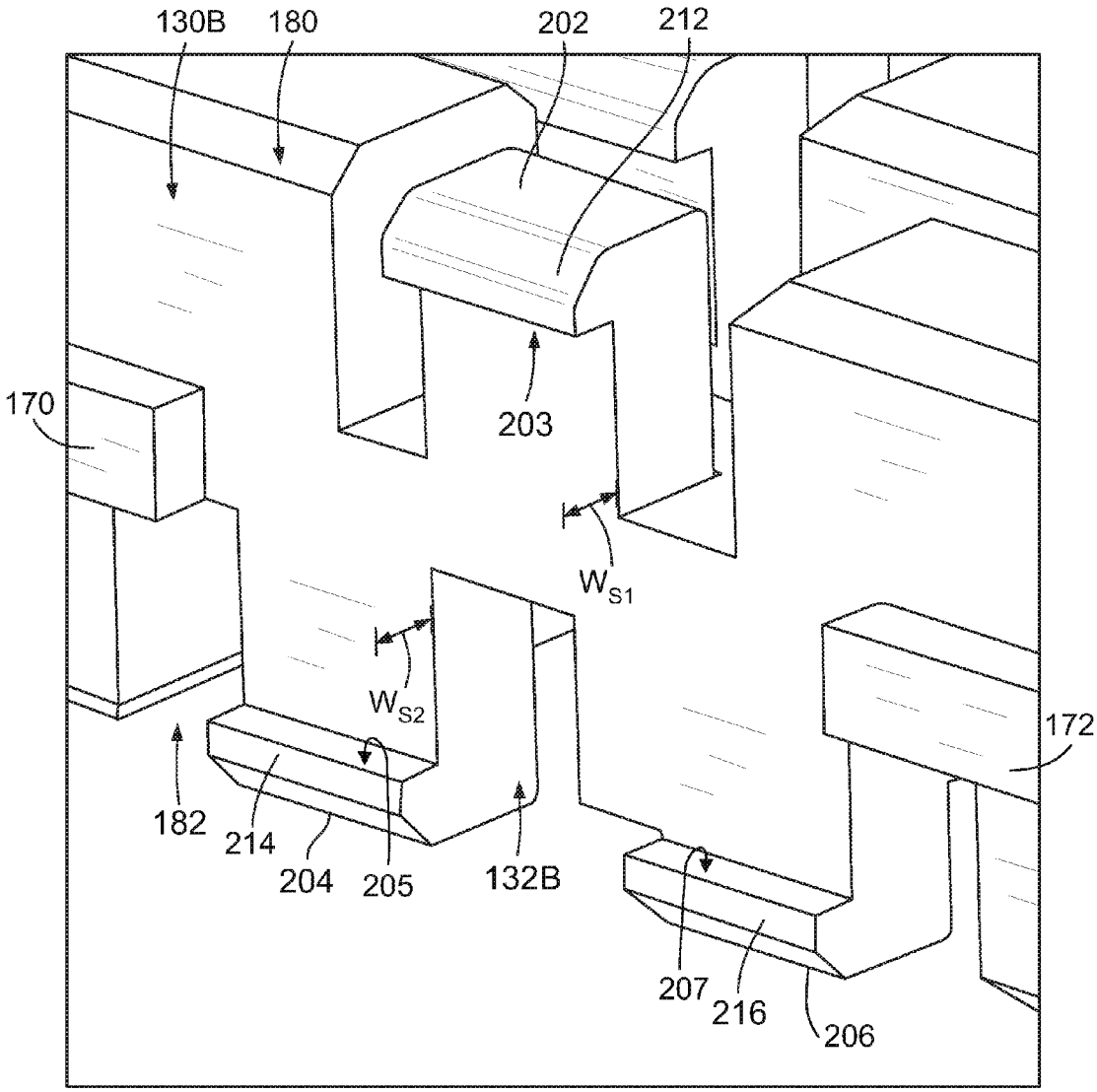
FIG. 4 is a perspective view of a slot that may be used with the connector shown in FIG. 1.

FIG. 4 is a perspective view of the slots 130B and 132B in which the bridge contacts 140 and 150 (FIGS. 2 and 3) have been removed. In the exemplary embodiment, the connector 100 (FIG. 1) includes locking features to hold the bridge contacts 140 and 150 at least partially within the slots 130B and 132B. For example, the connector 100 may include a locking feature 202 that is located proximate to the slot opening 180 to prevent the bridge contact 140 from moving out of the slot 130B when the bridge contact 140 is held therein. In addition, the connector 100 may include locking features 204 and 206 that are located proximate to the slot opening 182 to prevent the bridge contact 150 from moving out of the slot 132B when the bridge contact 150 is held therein.

In the exemplary embodiment, the locking feature 202 is a resilient latch that is moveable (e.g., through flexing) away from the slot opening 180 to provide access to the slot 130B. More specifically, the locking feature 202 may include a head portion 212 that blocks access into the slot 130B and blocks an exit path out of the slot 130B. The head portion 212 may include a projection that extends proximate to the slot opening 180. Likewise, the locking features 204 and 206 may be resilient latches that are configured to flex away from the slot opening 182 to allow the bridge contact 150 to be inserted therein. The locking features 204 and 206 may include respective head portions 214 and 216 that block access into or an exit path out of the slot 132B. The head portions 214 and 216 may include a projection that extends proximate to the slot opening 180.

Also shown, the locking features 202, 204, and 206 have respective blocking surfaces 203, 205, and 207. The blocking surface 203 is configured to face the bridge contact 140 when the bridge contact 140 is held within the slot 130B. If the bridge contact 140 is moved in a vertical manner to exit the slot 130B, the blocking surface 203 may engage the bridge contact 140 to prevent the bridge contact from exiting the slot 130B. Likewise, the blocking surfaces 205 and 207 may face the bridge contact 150 and engage the bridge contact 150 if the bridge contact 150 is moved in a vertical manner to exit the slot 132B. As such, the blocking surfaces 203, 205, and 207 may operate as positive stops to prevent the bridge contacts 140 and 150 from exiting the corresponding slots 130B and 132B.

To insert the bridge contact 140 into the corresponding slot 130B, the locking feature 202 may be deflected away from the corresponding slot opening 180 to allow the corresponding bridge contact 140 to be inserted therein. The locking feature 202 may then resile to a resting position. Similarly, to insert the bridge contact 150 into the corresponding slot 132B, the locking features 204 and 206 may be deflected away from the corresponding slot opening 182 to allow the corresponding bridge contact 150 to be inserted therein. The locking features 204 and 206 may then resile to a resting position. As shown, the head portions 212, 214, and 216 may be beveled to facilitate insertion of the corresponding bridge contacts.

The blocking surface 203 may be located to engage the bridge contact 140 so that the contact ends 184 and 187 (FIGS. 2 and 3) extend at least a predetermined distance $D_1$ (shown in FIGS. 5-8) away from the mating side $S_2$ (FIG. 1). Furthermore, the spacers 170 and 172 may be located with respect to the bridge contact 150 to engage the bridge contact 150 so that the contact ends 185 and 186 extend at least the predetermined distance $D_1$ away from the mating side $S_2$. As such, the contact ends 184-187 may engage the corresponding through-holes 116 (FIG. 1).

In addition or alternatively, the connector 100 may have other locking features. For example, the latches may have other shapes and have different locations with respect to the slot openings. Furthermore, locking features are not required to be formed with the housing material. For example, separable locking features may be attached to the housing 106 (FIG. 1) proximate to the slot opening 180 and 182. Furthermore, the locking feature for the slot 130B may be provided by a cap or top that rests on the loading side $S_1$.

Figure 5:
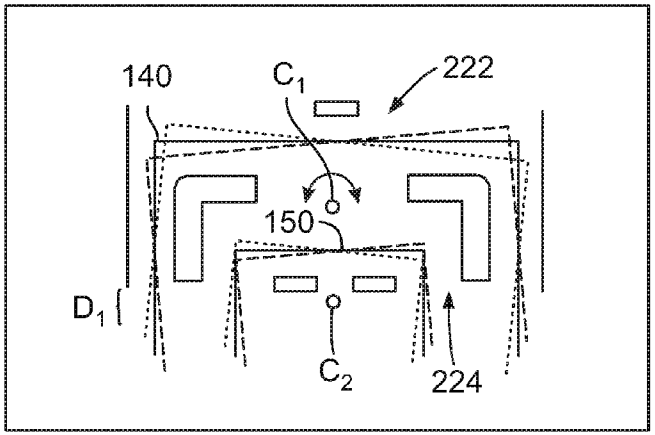
FIG. 5 illustrates bridge contacts pivoting about a lateral axis in accordance with various embodiments.

As will be described in greater detail below, various features of the connector 100 described herein may provide boundaries that define the restricted spaces 222 and 224 (FIG. 5). For example, as shown in FIG. 4, the blocking surfaces 203, 205, and 207 of the locking features 202, 204, and 206; interior wall surfaces that define the slots 130B and 132B; and wall surfaces of the spacers 170 and 172 may all provide boundaries that define the restricted spaces 222 and 224. As used herein, the term "float," and variations thereof, refers to a component that at least one of pivots and shifts within a corresponding restricted space. For example, in some embodiments, a bridge contact is floatable within a restricted space, which may be at least partially defined by a contact-receiving slot and optional locking features. Furthermore, a connector housing may float or move independently with respect to bridge contact(s) that are mechanically and electrically coupled to through-holes of different circuit boards.

FIGS. 5-8 are schematic views that illustrate the bridge contacts 140 and 150 moving within respective restricted spaces 222 and 224. FIG. 5 shows the bridge contacts 140 and 150 pivoting about respective centers of rotation $C_1$ and $C_2$. (For illustrative purposes, the bridge contacts 140 and 150 and different components of the housing 106 (FIG. 1) have not been drawn to scale.) More specifically, the bridge contact 140 may pivot within the restricted space 222 about a lateral axis that extends through the center of rotation $C_1$ and parallel to the lateral axis 190 (FIG. 1). The bridge contact 150 may pivot within the restricted space 224 about a lateral axis that extends through the center of rotation $C_2$ and parallel to the lateral axis 190.

Figure 6:
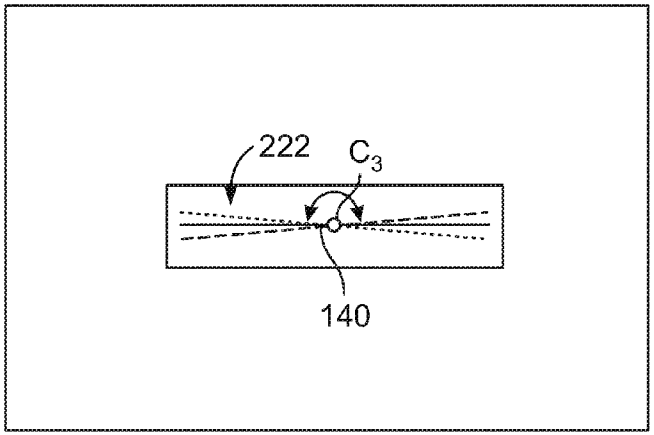
FIG. 6 illustrates bridge contacts pivoting about a vertical axis in accordance with various embodiments.

FIG. 6 shows the bridge contact 140 pivoting about a vertical axis within the restricted space 222. The vertical axis may extend through a center of rotation $C_3$ and parallel to the vertical axis 192 (FIG. 1). Although not shown, the bridge contact 150 may also pivot about a vertical axis. In both FIGS. 5 and 6, a maximum amount of rotation for the bridge contact 140 may be determined by interior wall surfaces of the housing 106 (FIG. 1) that define the slot 130B (FIG. 2) and/or the wall surfaces of the spacers 170 and 172 (FIG. 3). For bridge contact 150, a maximum amount of rotation may be determined by interior wall surfaces of the housing 106 that define the slot 132B (FIG. 3), the locking features 204 and 206 (FIG. 4), and/or wall surfaces of the spacers 170 and 172.

Figure 8:
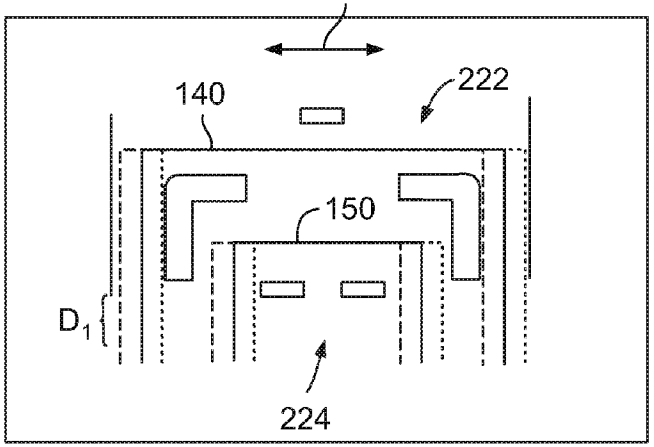
FIG. 8 illustrates bridge contacts shifting laterally in accordance with various embodiments.
Figure 7:
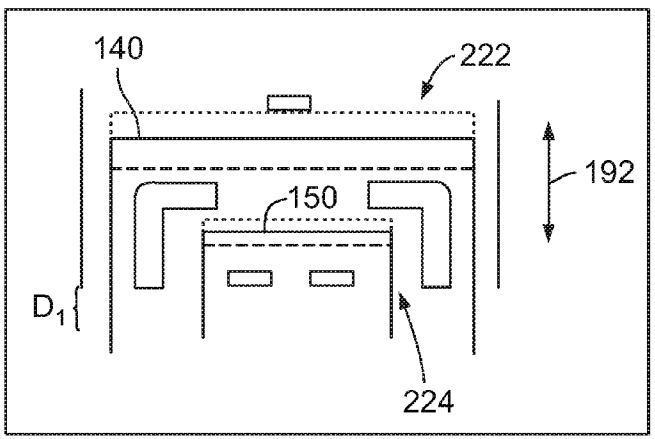
FIG. 7 illustrates bridge contacts shifting vertically in accordance with various embodiments.

FIGS. 7 and 8 illustrate the bridge contacts 140 and 150 shifting within the restricted spaces 222 and 224, respectively. More specifically, FIG. 7 shows the bridge contacts 140 and 150 shifting in a vertical manner within the restricted spaces 222 and 224, respectively. In other words, the bridge contacts 140 and 150 may move in a substantially linear direction along the vertical axis 192. A maximum vertical distance moved by the bridge contact 140 may be based upon the locations of the blocking surface 203 (FIG. 4) and the wall surfaces of the spacers 170 and 172 (FIG. 3). A maximum vertical distance moved by the bridge contact 150 may be based upon the locations of the blocking surfaces 205 and 207 and the wall surfaces of the spacers 170 and 172. FIG. 8, on the other hand, illustrates the bridge contacts 140 and 150 shifting in a lateral manner in a direction along the lateral axis 191. A maximum lateral distance moved by the bridge contact 140 may be based upon interior wall surfaces of the housing 106 (FIG. 1) that define the vertical sections 131 (FIG. 2) of the slot 130B. A maximum lateral distance moved by the bridge contact 150 may be based upon the wall surfaces of the spacers 170 and 172 and/or the locking features 204 and 206 (FIG. 4).

As shown in FIGS. 5, 7, and 8, the contact ends 184-187 (FIGS. 2 and 3) may extend at least a predetermined distance $D_1$ away from the mating side $S_2$ (FIG. 1) when the bridge contacts 140 and 150 float within the corresponding restricted spaces 222 and 224. In other words, the contact ends 184-187 may be moveable relative to the mating side $S_2$, but project at least the predetermined distance $D_1$ away so that the contact ends 184-187 may be inserted into and mechanically engage the corresponding through-holes 116 (FIG. 1).

Although each of FIGS. 5-8 only show one manner of shifting or pivoting, it is understood that the bridge contacts 140 and 150 may simultaneously pivot in both manners and/or shift in both manners. As such, the bridge contacts 140 and 150 may be floatable in a combination of directions along the axes 190-192 within the restricted spaces 222 and 224. However, in alternative embodiments, the bridge contact 140 and/or the bridge contact 150 may be floatable in only one direction or only two directions along the respective axes 190-192. For example, the bridge contact 140 may be sized and shaped with respect to the corresponding restricted space 222 so that bridge contact 140 is only moveable in a vertical manner. As another example, the bridge contact 140 may only be capable of shifting in a lateral direction and pivoting about the vertical axis that extends through the center of rotation $C_3$ (FIG. 6). Accordingly, the "floatability" of the bridge contacts 140 and 150 may facilitate mounting the connector 100 onto the circuit boards 102 and 104 (FIG. 1) and may also permit the housing 106 to move independently with respect to the bridge contacts 140 and 150 after the connector 100 is mounted thereon.

Figure 9:
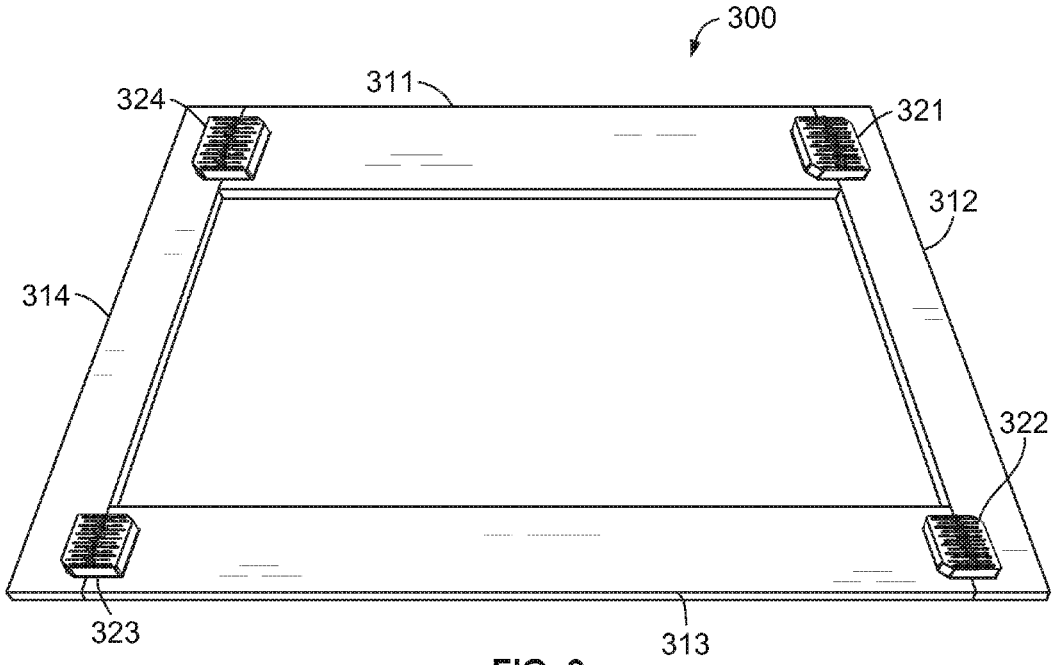
FIG. 9 is a perspective view of a circuit board assembly formed in accordance with one embodiment.

FIG. 9 is a perspective view of a circuit board assembly 300 formed in accordance with one embodiment. The board assembly 300 includes a plurality of circuit boards 311-314. The circuit boards 311-314 may be configured to form a frame that, for example, defines a perimeter of a touchscreen. The circuit boards 311-314 may be interconnected to each other through bridge connectors 321-324. The connectors 321-324 may be similar to the connector 100 described above with respect to FIGS. 1-8. As shown, the connectors 321-324 may be located at corners of the rectangular frame formed by the circuit boards 311-314.

Figure 10:
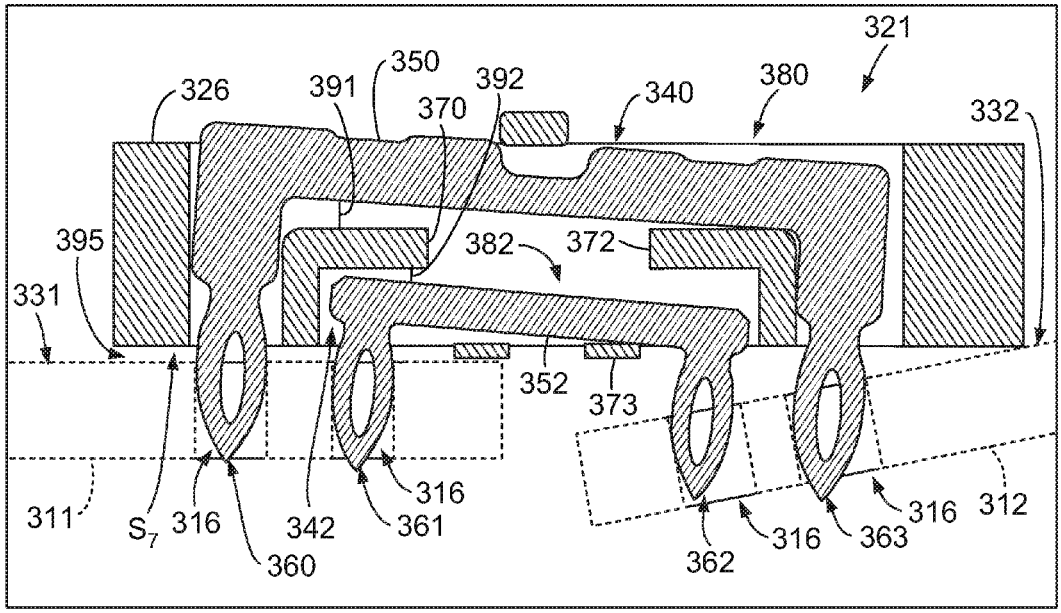
FIG. 10 is a cross-sectional view of a connector of the circuit board assembly shown in FIG. 9 when circuit boards are not properly positioned with respect to each other.

FIG. 10 is a cross-sectional view of the connector 321 when the circuit boards 311 and 312 are not properly positioned with respect to each other. As shown, the connector 321 includes a connector housing 326 having upper and lower slots 340 and 342 that include bridge contacts 350 and 352, respectively, therein. The connector 321 includes a mating side $S_7$. The mating side $S_7$ forms an interface 395 with board surfaces 331 and 332 of the circuit boards 311 and 312, respectively. The slots 340 and 342 may be respectively sized and shaped so that the bridge contacts 350 and 352 are floatable within restricted spaces 380 and 382 that are at least partially defined by the slots 340 and 342. Furthermore, the bridge contacts 350 and 352 may include contact ends 360-363 that are configured to be inserted into through-holes 316 of the circuit boards 311 and 312.

When the board assembly 300 is moved during, e.g., a manufacturing process, the circuit boards 311 and 312 may become improperly positioned with respect to each other. By way of example, the board surface 332 of the circuit board 312 may become misaligned or misoriented with respect to the board surface 331 of the circuit board 311 as shown in FIG. 7. When the circuit board 312 is inadvertently moved into the improper position, the contact ends 362 and 363 may remain mechanically and electrically coupled to corresponding through-holes 316 of the circuit board 312. However, the housing 326 may then move independently with respect to the bridge contacts 350 and 352 due to a size and shape of the restricted spaces 380 and 382. When the housing 326 moves independently with respect to the bridge contacts 350 and 352, the contact ends 362 and 363 may move relative to the mating side $S_7$.

As shown, movement of the bridge contact 350 may be restricted by a spacer 372. As shown, a gap 391 may develop between the bridge contact 350 and a spacer 370. Also, movement of the bridge contact 350 may be restricted by a locking feature 373. Likewise, a gap 392 may develop between the bridge contact 352 and the spacer 370. As such, the connector 321 may tolerate mispositioning of the circuit boards 311 and 312 (e.g., when the board surfaces 331 and 332 are not coplanar).

Embodiments described herein include bridge connectors having a connector housing and bridge contacts that electrically and mechanically couple two or more circuit boards together. The bridge connectors may be constructed and mounted to circuit boards using fewer steps than at least some other known connectors. Furthermore, embodiments described herein include circuit board assemblies that utilize the bridge connectors in holding a plurality of circuit boards together.

It is to be understood that the above description is intended to be illustrative, and not restrictive. As such, the above-described embodiments (and/or aspects thereof) may be used in combination with each other. Furthermore, although the above description referred to coupling circuit boards in touch systems, embodiments described above may be used in a variety of electrical devices and systems that require mechanically and electrically coupling two or more circuit boards together.

By way of example, the bridge connectors described herein may include only one bridge contact. Furthermore, the bridge connectors described herein may include only upper bridge contacts, such as the bridge contacts 140 described above, or only lower bridge contacts, such as the bridge contact 150 described above.

In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments.

Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A bridge connector configured to electrically and mechanically couple adjacent circuit boards, each circuit board including a board surface having through-holes, the connector comprising:

a connector housing having a mating side configured to interface with the board surfaces of the adjacent circuit boards when mounted thereon, the housing including a contact-receiving slot that at least partially defines a restricted space; and a bridge contact held within the slot and the restricted space, the bridge contact having a pair of contact ends that are spaced apart from each other and project from the mating side, the contact ends being inserted into corresponding through-holes of the adjacent circuit boards when the housing is mounted thereon, wherein the bridge contact is sized and shaped relative to the restricted space to float within the slot such that the bridge contact at least one of shifts or pivots therein, the contact ends moving relative to the mating side when the bridge contact floats within the slot;

wherein the housing includes a blocking surface that is positioned to prevent the bridge contact from moving out of the slot, the blocking surface facing the bridge contact in a direction that is one of away from the board surfaces or toward the board surfaces.

2. The connector in accordance with claim 1 wherein the contact ends extend at least a predetermined distance away from the mating side when the bridge contact floats within the restricted space.

3. The connector in accordance with claim 1 wherein the bridge contact is sized and shaped with respect to the restricted space so that the contact ends are moveable in a direction toward and away from the corresponding board surfaces.

4. The connector in accordance with claim 1 wherein the slot comprises a lateral section that extends parallel to the mating side and the bridge contact comprises a body portion extending within and along the lateral section, the lateral section and the body portion having respective lengths, wherein the length of the lateral section is greater than the length of the body portion to permit the bridge contact to shift in a lateral manner.

5. A bridge connector configured to electrically and mechanically couple adjacent circuit boards, each circuit board including a board surface having through-holes, the connector comprising:

a connector housing having a mating side configured to interface with the board surfaces of the adjacent circuit boards when mounted thereon, the housing including a contact-receiving slot that at least partially defines a restricted space;

a bridge contact held within the slot and the restricted space, the bridge contact having a pair of contact ends that are spaced apart from each other and project from the mating side, the contact ends being inserted into corresponding through-holes of the adjacent circuit boards when the housing is mounted thereon, wherein the bridge contact is sized and shaped relative to the restricted space to float within the slot such that the bridge contact at least one of shifts or pivots therein, the contact ends moving relative to the mating side when the bridge contact floats within the slot; and a locking feature that is located proximate to a slot opening of the slot, the locking feature engaging the bridge contact to prevent the bridge contact from moving out of the slot when the bridge contact is held therein.

6. The connector in accordance with claim 5 wherein the locking feature comprises a blocking surface configured to engage the bridge contact, the blocking surface being located with respect to the slot to engage the bridge contact so that the contact ends extend at least a predetermined distance away from the mating side.

7. The connector in accordance with claim 5 wherein the locking feature comprises a latch, the latch being moveable away from the slot opening to provide access to the slot.

8. The connector in accordance with claim 1 wherein the housing is shaped to hold the adjacent circuit boards coplanar with respect to each other.

9. The connector in accordance with claim 1 wherein the slot comprises a plurality of contact-receiving slots and the bridge contact comprises a plurality of bridge contacts, each slot at least partially defining a corresponding restricted space and each bridge contact configured to be held within a respective slot, each bridge contact having a pair of contact ends that are spaced apart from each other and project from the mating side, wherein each bridge contact is sized and shaped relative to the corresponding restricted space to float within the corresponding slot such that said bridge contact at least one of shifts or pivots therein, the contact ends of said bridge contact moving relative to the mating side when said bridge contact floats within the corresponding slot.

10. The connector in accordance with claim 9 wherein the plurality of slots include upper and lower slots, each upper slot being vertically stacked with respect to a corresponding lower slot.

11. The connector in accordance with claim 1 wherein the slot comprises a plurality of contact-receiving slots and the bridge contact comprises a plurality of bridge contacts, the connector consisting essentially of the housing and the plurality of bridge contacts.

12. A bridge connector configured to electrically and mechanically couple adjacent circuit boards, each circuit board including a board surface having through-holes, the connector comprising:

a connector housing having a mating side configured to interface with the board surfaces of the adjacent circuit boards, the housing including a contact-receiving slot having a slot opening;

a bridge contact inserted into the slot through the slot opening, the slot holding the bridge contact within the housing, the bridge contact having a pair of contact ends that are spaced apart from each other and project from the mating side, the contact ends being inserted into corresponding through-holes of the adjacent circuit boards when the housing is mounted thereon; and a locking feature located proximate to the slot opening, the locking feature engaging the bridge contact to prevent the bridge contact from moving out of the slot when the bridge contact is held therein.

13. The connector in accordance with claim 12 wherein the slot at least partially defines a restricted space, the bridge contact being sized and shaped relative to the restricted space to float within the slot such that the bridge contact at least one of shifts or pivots therein, the contact ends moving relative to the mating side when the bridge contact floats within the slot.

14. The connector in accordance with claim 12 wherein the locking feature comprises a blocking surface configured to engage the bridge contact, the blocking surface being located with respect to the slot and the bridge contact to engage the bridge contact so that the contact ends extend at least a predetermined distance away from the mating side, the blocking surface facing in a direction that is toward the board surfaces or away from the board surfaces.

15. The connector in accordance with claim 12 wherein the locking feature comprises a latch, the latch being moveable away from a slot opening to provide access to the slot.

16. A circuit board assembly comprising:

a plurality of circuit boards, each circuit board including a board surface having through-holes; and at least one bridge connector configured to electrically and mechanically couple adjacent circuit boards to each other, the at least one bridge connector comprising:

a connector housing having a mating side configured to interface with the board surfaces of the adjacent circuit boards when mounted thereon, the housing including a contact-receiving slot that at least partially defines a restricted space; and a bridge contact held within the slot of the housing, the bridge contact having a pair of contact ends that are spaced apart from each other and project from the mating side, the contact ends being inserted into corresponding through-holes of the adjacent circuit boards when the housing is mounted thereon, wherein the bridge contact is sized and shaped relative to the restricted space to float within the slot such that the bridge contact at least one of shifts or pivots therein, the contact ends moving relative to the mating side when the bridge contact floats within the slot;

wherein the housing is movable with respect to the bridge contact when the contact ends are mechanically engaged with the corresponding through-holes, the housing configured to move relative to the contact ends to permit movement of the circuit boards with respect to each other.

17. The circuit board assembly in accordance with claim 16 wherein the at least one bridge connector further comprises a locking feature that is positioned to prevent the bridge contact from moving out of the slot when the bridge contact is held therein.

18. The circuit board assembly in accordance with claim 16 wherein the at least one bridge connector is a plurality of bridge connectors that electrically and mechanically couple the circuit boards into a predetermined arrangement.

19. The connector in accordance with claim 1 wherein the bridge contact is sized and shaped relative to the restricted space so that the bridge contact is capable of pivoting within the restricted space.

20. The connector in accordance with claim 1 further comprising a locking feature that is located proximate to a slot opening of the slot, the locking feature being moveable with respect to the opening and including the blocking surface.

* * * * *